United States Patent [19]

Hamilton

[11] Patent Number: 4,653,713

[45] Date of Patent: Mar. 31, 1987

[54] LADDER TOP TOOL TRAY MOUNTING

[76] Inventor: James J. Hamilton, 12019 Goodman, Overland Park, Kans. 66213

[21] Appl. No.: 885,195

[22] Filed: Jul. 14, 1986

[51] Int. Cl.[4] ..... E06C 7/14

[52] U.S. Cl. ..... 248/238; 182/129; D32/53.1

[58] Field of Search ..... 182/129; 248/238, 223.4; D4/122; D32/53.1

[56] References Cited

U.S. PATENT DOCUMENTS

| | | | |
|---|---|---|---|
| 1,858,656 | 5/1932 | Batherman | 182/129 |
| 2,308,180 | 1/1943 | Larsen | 182/129 |
| 2,444,096 | 6/1948 | Faust | 248/238 |
| 2,798,652 | 7/1957 | Easton | 182/129 |
| 3,495,683 | 2/1970 | Broden | 182/129 |
| 3,631,572 | 1/1972 | Lange | 248/223.4 |
| 3,915,189 | 10/1975 | Holbrook | 248/223.4 |
| 4,261,435 | 4/1981 | Winter | 182/129 |
| 4,300,740 | 11/1981 | Killian | 248/238 |
| 4,428,458 | 1/1984 | Fiore | 182/129 |
| 4,480,810 | 11/1984 | Hall | 248/238 |

*Primary Examiner*—Reinaldo P. Machado
*Attorney, Agent, or Firm*—Thomas M. Scofield

[57] ABSTRACT

A mounting clip adapted to engage the top platform of a self standing or step ladder, such clip configured to be engaged by a specially shaped opening in the body parts of a tool tray or toolbox; a T section bar member resiliently fastenable to the top platform of a step ladder for engagement by transverse openings or tunnels in toolboxes or tool trays for fixing such boxes and trays removably to the top platform of such step ladder; a toolbox with configured openings or tunnels transversely formed through the side and any interior walls thereof for engagement with a T section mounting bar resiliently clipped to the top platform of a self standing or step ladder; a T section bar member that inserts into and positively engages, by spring action, the walls of a T shaped slot or tunnel in the bases of members, boxes and containers desired to be fixed atop a ladder.

20 Claims, 6 Drawing Figures

Fig. 1.
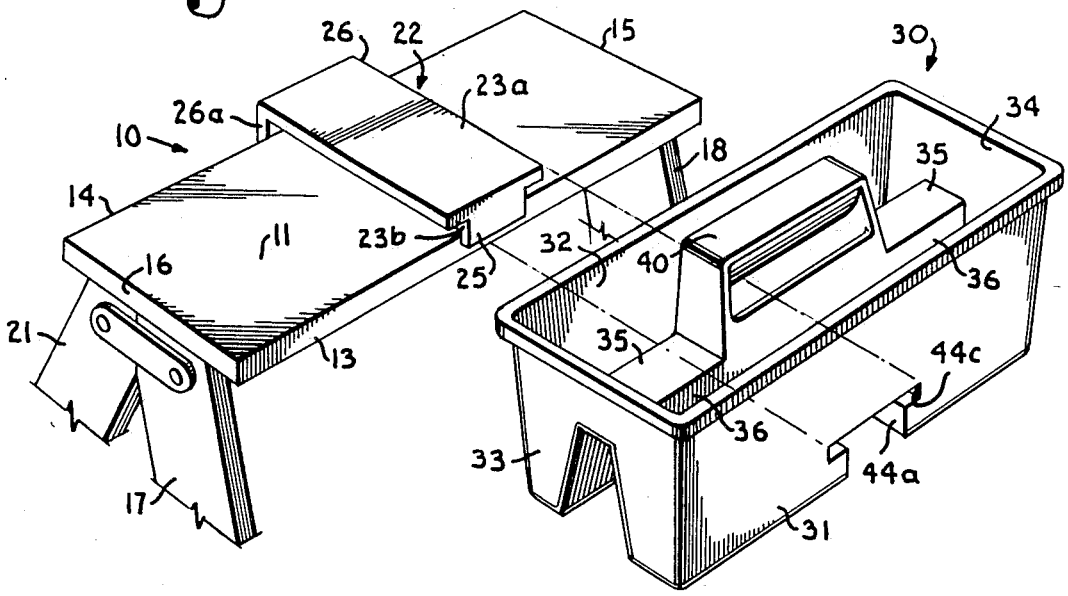
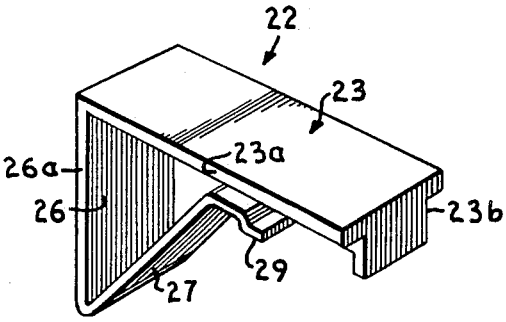
Fig. 2.
Fig. 3.
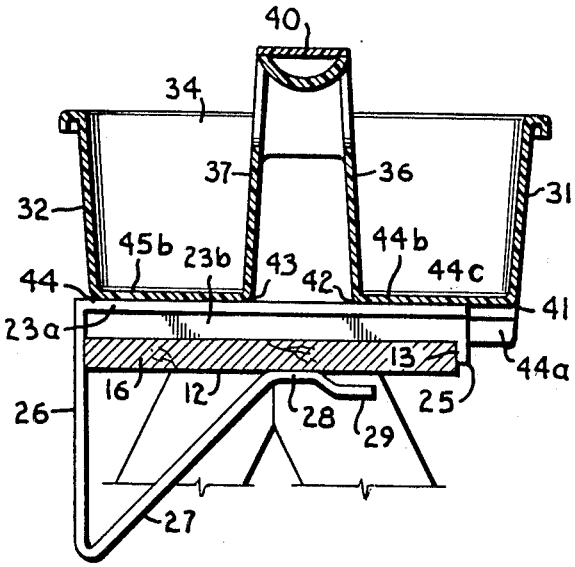

LADDER TOP TOOL TRAY MOUNTING

BACKGROUND OF THE INVENTION

A step or self standing ladder is an extremely well known and ancient device which enables an individual to climb thereupon and thus conveniently reach up to and work at heights and levels not obtainable therewithout. Step ladders are used by individuals to enable themselves to lift themselves up to various heights and reach, work with and repair things and articles normally out of reach. Workers of all types use step and other ladders to stably elevate themselves to those heights necessary to perform work on projects, objects and structures not normally reachable.

The word ladder may be descriptive of the structure and action of any ladder type, the step ladder merely being one form thereof typically used by craftsman (such as plumbers, electricians, carpenters and other artisans) in performing their work inside of or outside of residential or commercial building or other constructions. In interior work, step ladders are normally quite stable, by virtue of their four legged construction and their support by flat floors. They are available in a variety of sizes ranging from, typically, four to twelve feet in height. Out of doors, where relatively level surfaces on the ground and in artificial constructions permit their use, step ladders may typically be used in the larger sizes.

Many step ladders are relatively light and portable and can easily be moved from place to place (nearby) within a given work area without folding the ladder to its flat configuration. A step ladder, being free standing and self supporting, generally is handled and used in a manner different from other types of ladders. Workers commonly place toolboxes and tool trays on the top platform of a step ladder to work in a given area or at specific projects. Without means to secure the toolbox or tool tray to the ladder top platform, even though a ladder may be able to be moved without folding, generally speaking, the tool tray or box must be removed and placed on the floor or some other work surface when the ladder is moved.

The workers most frequently using a step ladder generally have present an array of tools, devices, parts and other things useful and necessary for the performance of their appointed task. It is most desirable to have all of these objects and materials available at one time when the worker is on the ladder as, first, climbing up and down the ladder to retrieve or obtain something is time and effort consuming. Additionally, however, work in process may not be able to readily be interrupted to seek another part or another tool and/or the worker may not be able to leave the location and height at which the work is being conducted for such.

As a result of these considerations, two approaches have generally been taken by workers and artisans. The first involves the use of a tool belt with suitable loops, straps, pockets and attachments so fashioned as to be able to hold various types of tools and other implement of the trade. The second of these is to have a tool tray or toolbox with some or all of the tools and materials needed for the job in question in the container. Often both circumstances are employed where certain tools are carried in the tool belt and certain tools are carried in the tool tray or box. If there is any problem with the tool belt and devices suspended therefrom interfering with the worker's movement on the ladder or handling of the toolbox, the tool belt is often discarded in favor of the toolbox.

When a toolbox or tool tray is employed on the top platform of a step ladder, the tools and other implements are readily available, directly in front of the worker. Unsecured placement of the tool tray or toolbox on the top platform of the step ladder, however, has its hazards. In the first place, the tool tray or toolbox is often of larger area or greater depth than the ladder platform. Depending on the distribution of the tools within the box, displacing the toolbox or tool tray from one side or another (or one edge or another) of the platform may result in a fall of the box to the floor with resultant disarray and requirement of recovery of tools and materials. Yet further, unsecured toolboxes and tool trays are not readily moveable with the ladder to a different position, even though it is not folded. Still further, heavy effort applied by the worker while on the ladder may move or shake the ladder and thus may displace and knock the toolbox off the top platform. In any case, much attention of the worker must be devoted to the security of the toolbox or tool tray on the top platform, if such is not properly and securely mounted thereon: in initial mounting of the ladder by the worker, in work on the ladder and in movement of the ladder around the work premises.

BRIEF SUMMARY OF THE INVENTION

The present invention relates generally to toolboxes and tool trays, as well as means for removably fixably mounting such toolboxes and tool trays on the top platform of conventional step ladders in such manner as to secure same during mounting of the ladder by the worker, work on the ladder by the worker and movement of the ladder around by the worker with or without folding thereof.

The subject device involves a mounting clip which firmly, powerfully and positively may be clamped onto the top and bottom surfaces of the top platform of a step ladder. The upper portion of the clip includes a T section beam which preferably extends across at least a substantial portion of the depth of the ladder top platform, typically extends the entire depth thereof and may extend yet further.

In connection therewith, there is provided a somewhat modified, but otherwise conventional toolbox or tool tray. Briefly stated, *any* conventional toolbox or tool tray, when modified to have a T slot therein, may be employed with this invention.

The entire point of the invention is to provide a single spring loaded engaging member which clips powerfully onto the top platform of the step ladder, which engaging member slidingly yet powerfully can engage the walls of a T slot formed in the bottom and side walls of a tool tray or toolbox transverse to the length dimension thereof whereby, when such engagement is made, movement of the toolbox or tool tray on the ladder platform will not take place until the engagement is deliberately undone or disengaged. In this manner, the location of the tool tray may be provided laterally any where along the top platform of the step ladder to best meet the artisan's needs and requirements, although central mounting of the tray or box will generally be employed.

THE PRIOR ART

Applicant is aware of the following patent directed to a "Step Ladder Utility Box", U.S. Pat. No. 4,310,134 issued Jan. 12, 1982, inventors Schopp et al. This patent shows a utility box for tools and parts which may be placed upon and removably secured to the top platform of a step ladder.

Applicant is aware of the following two patents directed to sliding T section engagement of articles, specifically:

Streit U.S. Pat. No. 994,797 "Adjustable Book Rests", issued June 13, 1911 and

Yust "Stadium Seat Arm Gripping Tray", U.S. Pat. No. 4,262,962 issued April 21, 1981.

The following patents are directed to various devices for securing various means to ladders and parts thereof:

Goldberg U.S. Pat. No. 1,824,344 "Means For Securing Dishes On Ships Tables", issued Sept. 22, 1931;

Batherman U.S. Pat. No. 1,858,656, issued May 17, 1932 for "Support For Blow Torches";

Faust U.S. Pat. No. 2,444,096, issued June 29, 1948 for "Paint Receptacle . . . ";

Touchett U.S. Pat. No. 2,444,584 "Sloping Bottom Tray And Support Structure" issued July 6, 1948;

Rosing U.S. Pat. No. 2,487,731 "Parking Meter Mounting" issued Nov. 8, 1949;

Elm U.S. Pat. No. 2,837,306 "Ladder Attachment For Paint Can", issued June 3, 1958;

Broden U.S. Pat. No. 3,495,683 "Roller Pan Holder For Ladders", issued Feb. 17, 1970;

Calbow, et al U.S. Pat. No. 3,502,294 "Mounting Assembly", issued Mar. 24, 1970;

DeLuca U.S. Pat. No. 3,842,936 "Compartmentalized Accessory Tray Assembly For Ladders", issued Oct. 22, 1974;

Cupp, et al U.S. Pat. No. 4,205,411, issued June 3, 1980 "Universal Paint Tray" (FIG. 11);

Fiore U.S. Pat. No. 4,428,458 "Foldable Ladder" issued Jan. 31, 1984; and

Hall U.S. Pat. No. 4,480;810, issued Nov. 6, 1984 for "Ladder Caddy".

OBJECTS OF THE INVENTION

A first object of the invention is to provide improvements over the construction seen in the U.S. Pat. No. 4,310,134, issued Jan. 12, 1982 for "Step Ladder Utility Box", inventors Schopp, et al.

Another object of the invention is to provide improvements in and devices for strongly yet removably mounting toolboxes and tool trays with respect to the top platform of a self standing or step ladder.

Another object of the invention is to provide a combined mounting clip and toolbox or tool tray construction which operate together to securely, yet removably, mount the toolbox or tool tray on the top platform of a step ladder.

Another object of the invention is to provide a one point or single zone mounting means for a conventional (yet modified) toolbox or tool tray on the top platform of a step ladder, which point or zone may be moved laterally to and fro as needed to various positions on the said step ladder top platform in order to symmetrically or asymetrically mount the toolbox or tool tray thereon for various purposes.

Another object of the invention is to provide a mounting clip which is adapted to secure toolboxes and tool trays of conventional yet modified type to the top platform of a step ladder, whether or not the toolbox or tool tray has an axial divider therewithin, such box or tray with or without one or more transverse dividers, as well.

Yet another object of the invention is to provide a novel mounting clip which securely grips a toolbox, tool tray or other container to the top platform of a step ladder, which clip is readily applied and disengaged therefrom and which may be applied at various positions along the length of the step ladder top platform, thus to vary the position of the tool tray or toolbox to be engaged therewith as may be desired or required by the user.

Another object of the invention is to provide improvements in a toolbox, tool tray or other container to adapt same for use with a particular form of mounting clip for the top platform of a step ladder, such changes and adaptations minimally, if at all, effecting the utility, shape, configuration and capacity of known conventional toolboxes, tool trays or containers.

Another object of the invention is to provide a mounting means cooperating with a toolbox, tool tray or container construction wherein the width of the mounting and securing contact on the step ladder top platform may be provided as quite broad or quite narrow as desired, there still just being one line, point or zone of mounting contact with the step ladder top platform, thus to give great mounting versatility to the assembly.

Yet another object of the subject invention is to provide a mounting clip to removably secure tooltrays, tool boxes and other containers with respect to the top platform of a step ladder wherein the mounting clip itself is securely engageable with the said top platform and not removable therefrom without forceably tilting the mounting clip against the action of the resilient means associated therewith.

Other and further objects of the invention will appear in the course of the following description thereof.

THE DRAWINGS

In the drawings, which form a part of the instant specification and are to be read in conjunction therewith, embodiments of the invention are shown and, in the various views, like numerals are employed to indicate like parts.

FIG. 1 is an exploded three-quarter perspective from above of the top platform of a self-standing or step ladder with the subject mounting clip being shown attached to the center of the ladder platform, a modified yet otherwise conventional tool tray or toolbox being shown spaced away from the mounting clip before engagement therewith.

FIG. 2 is a three-quarter perspective view from above of the mounting clip of FIG. 1.

FIG. 3 is a transverse section taken through the assembly of FIG. 1 with the tool tray mounted on the mounting clip, the section taken centrally through the entire assembly at right angles to the longitudinal axis of the ladder platform.

Figure 4:
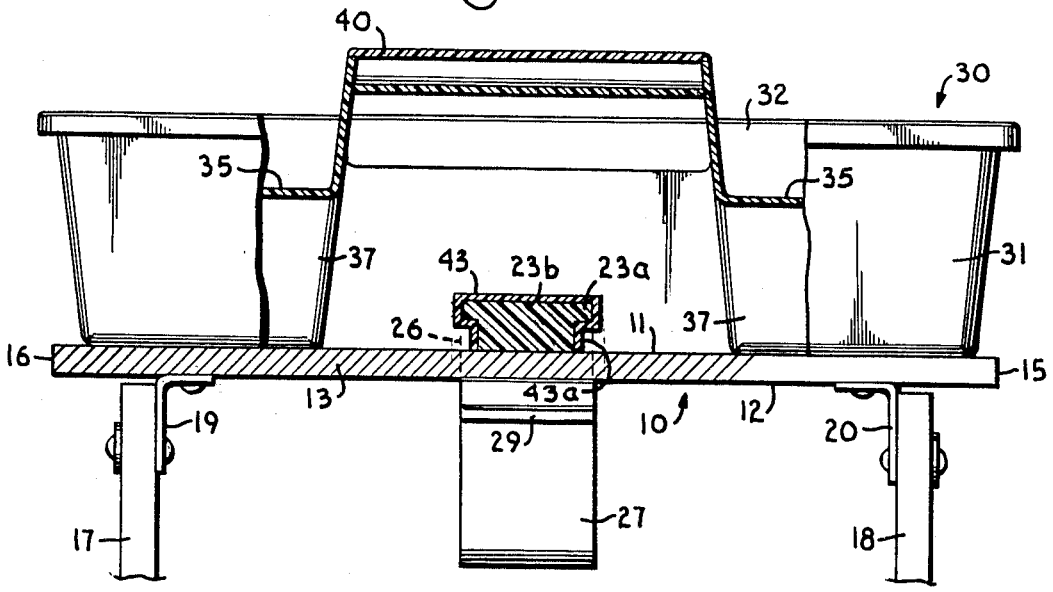
FIG. 4 is a front view of the assembly of FIG. 3 and the assembled array of FIG. 1 with the center portion of the view cut away and in section showing the T slot of the tool tray and the upper portion of the mounting clip engaged axially, centrally of the tool tray.
Figure 5:
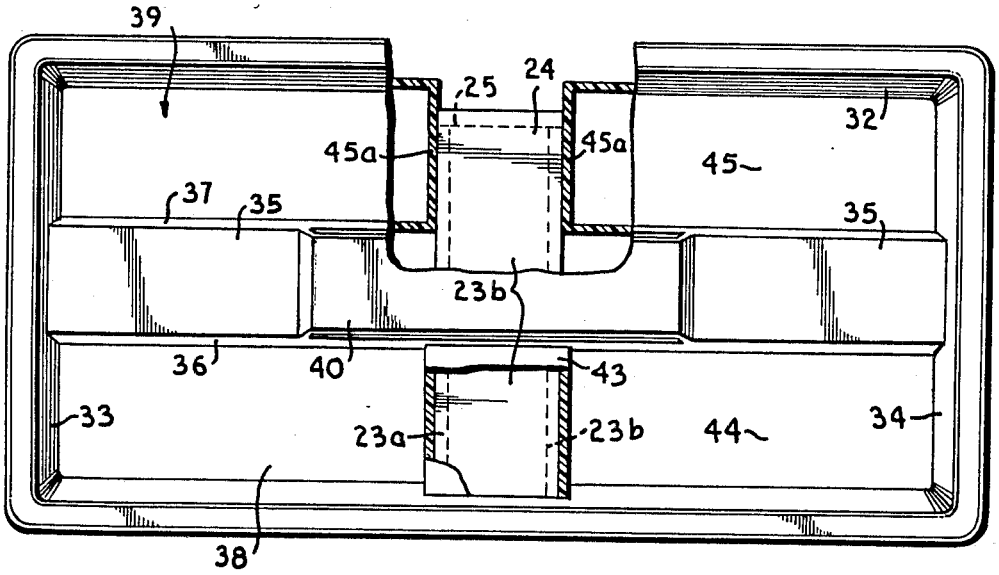

FIG. 5 is a plan view from above of the assemblies of FIGS. 3 and 4 and the assembled elements of FIG. 1 with the tool tray slideably mounted on the mounting clip, the front center of the device cut through to show the engagement of the mounting clip top member with the T slot walls of the tool tray, the rear center of the view showing the top portion of the tool tray T slot passage cut away to show the top of the clip.

Figure 6:
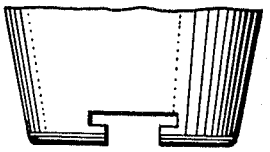

FIG. 6 is a side view of the lower end of a bucket having formed therein the T passage of the subject disclosure.

STRUCTURE AND FUNCTION

The structure of a conventional step ladder is so well known that only the uppermost part thereof is shown in the drawing figures to give the context of operation for the present invention. In the views of FIGS. 1, 3 and 4, there is seen the top platform 10 of a step ladder which platform has upper surface 11, lower surface 12, front longitudinal edge 13, rear longitudinal edge 14 and side edges 15 and 16. Front legs 17 and 18 are typically pivotally mounted on L shaped members 19 and 20 (FIG. 4) which are fixed to the underside of platform 10. One of the rear legs 21 is seen in FIG. 1.

As noted, the structure of a step ladder with the steps or risers fixed spaced along the vertical lengths of front legs 17 and 18 with suitable collapsible braces (not seen) interconnecting the front and rear legs is well known and ancient to the art and will not here be further illustrated or described. Bracing rods space apart the rear legs. The front and rear legs 17, 21 may be folded upon one another, upon suitable release of collapsible bracing so that the ladder may be carried in folded, legs overlapping position from one location to another or stored or transported in vertical or horizontal position. Details of conventional step ladders are shown in some of the references cited above.

In use of the step ladder, typically, the operator or user will stand, when working, generally only on the steps below the top platform 10. Occasionally, in very unusual conditions, such as mounting of a ladder on a very flat, frictionally engaging floor and/or the ladder being held by a third party or parties for security, the worker may stand to work on the top platform. Most generally, however, the top platform is used as a support surface upon which tools, parts, materials or the like are placed either per se, or in receptacles, containers or tool trays and toolboxes of the type here illustrated.

Referring to the various figures but particularly FIG. 2, therein is shown, separately in FIG. 2, and engaged with the ladder top platform in the other figures, a platform clip generally designated 22. Clip 22 includes an elongate upper member 23 which is of substantial T shape in vertical transverse section. This T shape includes the upper horizontal T bar 23*a* and the lower vertical T leg 23*b*. At the rear of the elongate upper member 22 there is provided a vertical sheet or plate 26 having side, normally vertical edges 26*a* and 26*b*. The latter acts as a stop for the engagement with the tool tray to be described. Plate or sheet 26 is an approximate one half of an asymmetrical U or V member (side view FIG. 3) made up, in the other leg thereof, of inclined sheet or plate 27. At the upper end of plate or beam 27, there is provided flat portion 28, then downwardly and outwardly angled portion 29 for operator gripping purposes to disengage the clip from the platform after engagement therewith.

There are many forms of tool trays and toolboxes. One of the simplest forms of boxes is that seen in Schopp et al U.S. Pat. No. 4,310,134 wherein the container is merely a rectangular box with elongate side walls, normally vertical, normally vertical end walls attached thereto and a bottom wall connecting to all. In the event that such a simple container were to be used with the mounting clip which is a portion of the subject invention, the structure would be substantially the same as seen in Schopp 134, but T shaped openings would be formed in the side walls above the bottom wall (in one variation) so that the upper portion of the clip would overlie the floor of the box. In such case, the depending lip 25 could not be employed as such would not fit through the T openings in the box. On the other hand, should the T openings be provided in the manner disclosed with respect to the subject tool tray, then the front engagement 25 may be employed. Specifically, that is, the base portion of the T cut through the container would include the floor thereof.

Most tool containers, however, are not of the configuration employed in Schopp et al 134, rather they are quite different in form for purposes of use by artisans in many ways unrelated to use with respect to the top platform of a ladder. Thus, in the case of most artisans, they prefer to use the highly convenient, multi-compartmented, handle bearing tool trays and boxes currently available, such typically formed of molded plastic. The container, tool tray or toolbox shown in the various views of FIGS. 1 and 3–5, inclusive represents a typical, but not necessarily limiting tool tray or box of conventional type, such modified so as to be useable with the mounting clip of previous description.

The tool tray of FIGS. 1 and 3–5, inclusive is actually substantial symmetrical and can be reversed upon itself without showing different structure in any direction. For the purposes of description, however, in the views here present, reference will be made to front and rear or back sides of the tool tray for orientation with respect to the drawing figures and the mounting clip. Said slightly otherwise, in the view of FIG. 1, the tool tray or toolbox can be turned 180° for engagement with the mounting clip and there will be no substantial difference in structure of the tool tray, inside or outside.

Toolbox 30 has front side wall 31 and rear side wall 32 as well as end walls 33 and 34. A circumferential lip or flange (unnumbered) typically runs around the entire top of the side and end walls. The floor will be later numbered. Typically, the interior of the toolbox or tool tray is divided by an elongate arch running from end wall 33 to end wall 34 (or vice versa) having top wall 35, front side wall 36 and rear side wall 37. This arch typically divides the container into front and rear compartments 38 and 39. A handle section generally designated 40 is formed or molded integral with the center portion of walls 35–37, inclusive. The handle and arch are formed to enable stacking of trays. There may be provided (not seen) one or more transverse subcompartment dividing walls normal to a side wall 31 or 32 and one or both of the side walls 36 and 37. Such subdivide an elongate compartment into two smaller compartments. The height of the walls of the elongate arches 35–37 may vary from toolbox to toolbox, as is the case with the also conventional transverse subdividing wall(s) mentioned. Indentations may be provided into the top of the wall portions 35 to receive nuts, bolts, screws, nails and the like. All this structure previously described with respect to the toolbox or tool tray is conventional and may vary, as noted.

Formed through each of walls 31, 36, 37 and 32 are T-shaped slots 41, 42, 43 and 44. (Optionally, only one of walls 31 and 32 may have such slot, but, in any case, preferably both walls 36 and 37 are slotted. In order to make engagement with the clip 22 from either side possible, all four walls are preferably slotted.) The T leg portions of the slots as at 43*a* in FIG. 4 preferably, but not necessarily, penetrate the floor portions 44 and 45 of compartments 38 and 39. If member 25 is present, they must penetrate the floor portions. At least the portions 45*a* (FIG. 5) and 44*a* (FIG. 3) are preferably vertically walled up (or enclosed) to the base of the T horizontal bar extensions of the openings but, most preferably, additionally as may be seen in FIG. 3, as at 44*b* and 44*c*, preferably the entire length and extent of the two slots through floor portions 44 and 45 are walled over or enclosed to seal against any extension of the clip T member 23*a*, 23*b* into the compartments 38 and 39. Such top enclosed T passageways seal the compartments 38 and 39 in the entire floor thereof.

While it is feasible to design the engaging clip and tool tray so that the bottom edge or surface of leg 23*b* of the T upper part of the engaging clip overlies the floor of the tool tray or tool tray chambers, it is preferred that the floor of the tool trays or caddies also be cut through as may be seen in the views of FIGS. 1, 3 and 4 whereby the overlying end engaging member 25 may be employed with the device. This gives additional security with respect to the attachment or securement of the clip to the top platform. The fit of the T member 23 in the T slots or openings in the tool trays or boxes is preferably a strong frictional engagement so that the tray, once engaged, will stay engaged until deliberately removed. Such frictional engagement is preferably between the underside of the horizontal extremities of the horizontal T bar 23 and the bottom portions of the T bar horizontal slots or openings provided in the toolbox or tool tray. This means that the action of the spring member 26, 27, 28, 29 strongly forces the extremities of the horizontal T portions 23*a* to bear on the upper faces of the corresponding portion of the openings or tunnels formed in the tool tray or box.

In operation of the subject device, assuming an erect, work positioned step ladder or self standing ladder with a top platform 10, the clip 22 of FIG. 2 is first mounted on the said top platform. This means that the operator grasps flange 29 on the front of spring member 26, 27, 28 and 29, as well as the shelf 24, 25 (two hands) in order to separate, sufficiently, the engaging portion 28 from the underside of portion 23*b* of the top part of the clip. With such separation, the open clip is slid onto and snapped over (and under) the top and bottom surfaces 11 and 12 of the platform 10. End flange 25 overlies front edge 13 of platform 10. The powerful spring action rigidly holds the upper and lower portions of the clip in engaging contact with the platform 10.

At this point, the tool tray or box may be engaged with the clip upper portion in the manner seen in FIG. 1. Because it is desired that there be a strong forceful engagement of the clip with the slots or tunnels in the toolbox, the forward or leading edges of the T horizontal bar 23*a* portion may be beveled on the undersides thereof to ride slightly up over the toolbox slots or tunnel members. Likewise, the leading edges of the outboard slots and tunnels of the toolbox may be likewise beveled to enable the initial engagement to be successfully and easily made in such manner to cause either at least a very strong downward forcing engagement or slight raising of the top clip portion against the action of the spring engaging the underside of the ladder top platform. The toolbox is then forced or slid rearwardly on the top platform 10 of the ladder until, preferably, the wall 32 of the toolbox abuts against the vertical portions 26, 26*a* of the clip.

The ladder position is seen in FIGS. 3 and 5. It is noted that the toolbox is shown as typically (which is the case) of greater depth than the depth of top platform 10. If the toolbox is not of such depth, then it will essentially overlie the platform or portion 23*a* of the top part of the clip.

In order to move the ladder, in most cases, the engagement will be sufficient that the toolbox may be carried with the ladder, whether the legs remain spread or are folded, so long as the top portion of the platform is kept relatively level. To remove the device from the ladder, first wall 31 is grasped or wall 31 and handle 40 and the device (toolbox) pulled to the right in FIG. 1 toward the position there pictured. This pull must be made against the frictional engagement previously discussed. Once the toolbox has been removed from engagement with the clip, then the operator typically grasps flange 29 and the side edges of T top horizontal flange 23*a* to permit the clip to be disengaged from the ladder top platform.

Thus it may be seen that what has been here provided comprises novel ladder attachment and engageable carrying means for use in conjunction with the top platform of a self standing ladder. The ladder top platform is typically substantially rectangular in plan, side and end views with top and bottom sides and has side and end edges.

A tool tray or box comprising an elongate, substantially rectangular container in top plan view is to be secured, removably, to said ladder top platform. The tray or box has substantially parallel side walls, substantially parallel end walls and a bottom wall. The side and end walls thereof normally extend substantially vertically when the bottom wall is placed on a substantially horizontal surface such as the ladder top platform.

The tool tray also may have an axial divider formed integrally therewith. Such an axial divider typically comprises an elongate, length-axial arch having two substantially vertical interior side walls and at least one top wall. In such case, the bottom wall of the tray is interrupted at the axial divider along the center length of the tray with the interior side walls of the axial divider joining, at their lower ends, with the interior edges of the bottom wall and, at their upper ends, with a normally horizontal top wall, whereby an interior arch is formed in the tray extending upwardly into the bottom side thereof.

A platform engaging clip is provided which includes an elongate, upper member of substantial T-shape in vertical transverse section. This member is of sufficient length to extend a distance at least somewhat greater than the width of one side wall and one adjacent axial divider interior side wall. A resilient lower clip member is fixed adjacent to one end of said upper member, such being adapted to strongly resiliently and removably engage the underside of the ladder top platform.

A T section passageway is formed through the lower portion of each of the said tray side walls and each of said axial divider interior side walls essentially centrally thereof. Each such passageway is adapted to receive the clip upper member therethrough in frictional engagement. In this manner, when the clip upper member engages at least one of the tool tray side walls and at least the adjacent one of the axial divider interior side walls and the clip lower member engages the underside of the ladder top platform, the tray is removably fixed on the platform top.

The elongate upper member of the platform clip is preferably at least of sufficient length so as to extend through at least one side wall of said tray and both of said axial divider interior side walls.

The resilient clip member is preferably fixed to one end of the upper platform clip member and, at the normally upper end thereof, is preferably of equal width to said upper member, whereby to act as a stop with respect to said tray wall openings. The entire lower clip resilient engaging member may be of such equal width.

The T section passageways through the toolbox or tool tray walls may be formed through the lower portions of the tray and axial divider side walls above the bottom wall of the tray or, alternatively, through the bottom wall of the tray, as well. They are preferably walled over and around for closure purposes.

The lower clip member is preferably of an asymmetrical V shape in side view with one upper end thereof connected to the end of said clip upper member normally being substantially vertical in orientation. The portion of the lower clip member adapted to engage the underside of the ladder platform is norma11y inclined from the vertical and has an inverted U-shaped portion at the end thereof to enble grasping thereof by the operator to aid in disengagement of the device from the ladder upper platform.

At least one of the two tray portions separated by the axial divider may be transversely divided by a transverse divider comprising an arch having two substantially vertical interior side walls and at least one top wall, the bottom wall of said tool tray or box interrupted at said transverse divider across the center length of the tray with the interior side walls of the transverse divider joining at the lower ends the interior edges of the bottom wall. Thus, a transverse interior arch is formed in a tray and the bottom side thereof. In this case, the side walls of the tool tray, the interior axial divider walls and the interior transverse divider walls all may be so formed as to be able to receive the length of the upper T bar mer:ber of the platform clip therewithin. Transitional portions thereof are preferably walled over and around to the base walls.

FIG. 6 shows the T section passageway (walled over and around for fluid sealing purposes provided in the bottom of a plastic bucket. For cleaning purposes the inwardly projecting lower portions defining the leg of the T may be solid or walls off from the bucket interior. The action of engagement and disengagement with clip 22 is the same.

From the foregoing, it will be seen that this invention is one well adapted to attain all of the ends and objects hereinabove set forth together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

I claim:

1. Attachment and carrying means for use in conjunction with the top platform of a self standing ladder, said ladder top platform being substantially rectangular in plan, side and end views with top and bottom sides and side and end edges, comprising, in combination:

(1) A tool tray comprising an elongate, substantially rectangular box in top plan view, said tray having substantially parallel side and substantially parallel end walls and a bottom wall, said side and end walls normally extending substantially verticall when said bottom wall is placed on a substantially horizontal surface, (2) a platform clip including an elongate upper member of substantially T shape in vertical transverse section, said member of sufficient length to extend a distance at least somewhat greater than the width of said side walls and (3) a resilient lower clip member fixed adjacent to one end of said upper member and adapted to strongly resiliently and removably engage the underside of said ladder top platform, and (4) a T-section passageway formed through the lower portion of each of said tray side walls essentially centrally thereof, each adapted to receive the clip upper member therethrough, whereby, when the clip upper member engages the tool tray side walls and the clip lower member engages the underside of the ladder top platform, the tray is removably fixed on the platform top.

2. Means as in claim 1 wherein the T-section passageways are formed through the lower portion of each of said tray side walls above the bottom wall thereof whereby, when the clip upper member engages the tool tray side walls, it overlies the said bottom wall.

3. Means as in claim 1 wherein the lowermost portions of said T-section passageways are also formed through the bottom wall of said tool tray for the vertical leg of said T to pass therethrough in the bottom portion thereof.

4. Means as in claim 1 wherein said resilient clip member is fixed to one end of said upper platform clip member and is of equal width in its entire extent to said upper member, whereby to act as a stop with respect to said tray wall openings and stably grip the latter platform underside.

5. Means as in claim 1 wherein said lower clip member is an asymmetrical V shape in side view with one side of the V having one upper end thereof connected to one end of said clip upper member and normally being substantially vertical in orientation, the other portion of said lower clip member being adapted to engage the underside of the ladder platform, being normally inclined from the vertical and having an inverted U-shaped portion at the end thereof to enable grasping thereof by the operator to aid disengagement of the device from the ladder upper platform.

6. Means as in claim 1 including a portion of the elongate upper member of said platform clip being at least equal to the width of the ladder top platform in length, there being a downwardly extending member on said elongate upper member free end to overlie and engage the said platform edge.

7. Means as in claim 1 wherein at least a portion of said platform clip elongate upper member is of a length equal to the platform width of the ladder top platform and the width of the tool tray is greater than the width of the top platform.

8. Attachment and carrying means for use in conjunction with the top platform of a self standing ladder, said ladder top platform being substantially rectangular in plan, side and end views with top and bottom sides and side and end edges, comprising, in combination:

a tool tray comprising an elongate, substantially rectangular box in top plan view, said tray having substantially parallel side walls, substantially parallel end walls and a bottom wall, said side and end walls normally extending substantially vertically when said bottom wall is placed on a substantially horizontal surface, said tool tray also having an axial divider formed integrally therewith, said axial divider comprising an elongate, length axial arch having two substantially vertical interior side walls and at least one top wall, the bottom wall of said tray interrupted at said axial divider along the center length of the tray with the interior side walls of the axial divider joining at their lower ends with the interior edges of the bottom wall, whereby an interior arch is formed in the tray and upwards into the bottom side thereof, a platform clip including an elongate, upper member of substantial T shape in vertical transverse section, said member of sufficient length to extend a distance at least somewhat greater than the width of one side wall and one adjacent axial divider interior side wall and a resilient lower clip member fixed adjacent to one end of said upper member adapted to strongly resiliently and removably engage the underside of said ladder top platform, and a T section passageway formed through the lower portion of each of said tray side walls and each of said axial divider interior side walls essentially centrally thereof, each adapted to receive the clip upper member therethrough, whereby, when the clip upper member engages at least one of the tool tray side walls and the adjacent one of the axial divider interior side walls and the clip lower member engages the underside of the ladder top platform, the tray is removably fixed on the platform top.

9. Means as in claim 8 wherein the elongate upper member of the platform clip is of sufficient length so as to extend through at least one side wall of said tray and both of said axial divider interior side walls.

10. Means as in claim 8 wherein said resilient clip member is fixed to one end of said upper platform clip member and is of equal width in its entire extent to said upper member, whereby to act as a stop with respect to said tray wall openings and stably grip the ladder platform underside.

11. A device as in claim 8 wherein said T-section passageways are formed through the lower portions of the tray and axial divider side walls above the bottom wall of the tray.

12. A device as in claim 8 wherein said T-section passageways are additionally formed through the bottom wall of the tray.

13. Means as in claim 8 wherein said lower clip member is an asymmetrical V shape in side view with one upper end thereof connected to the end of said clip upper member normally being substantially vertical in orientation, the portion of said lower clip member adapted to engage the underside of the ladder platform being normally inclined from the vertical and having an inverted U-shaped portion at the end thereof to enable grasping thereof by the operator to aid disengagement of the device from the ladder upper platform.

14. Means as in claim 8 including a portion of the elongate upper member of said platform clip being at least equal to the width of the ladder top platform in length, there being a downwardly extending member on said elongate upper member free end operative to overlie and engage the said platform edge.

15. Means as in claim 8 wherein at least a portion of said platform clip elongate upper member is of a length equal to the platform width of the ladder top platform and the width of the tool tray is greater than the width of the top platform.

16. Means as in claim 8 wherein at least one of said tool tray portions separated by said axial divider is transversely divided by a transverse divider comprising an arch having two substantially vertical interior side walls and at least one top wall, the bottom wall of said tray being interrupted at said transverse divider across the center length of the tray with the interior side walls of the transverse divider joining at their lower ends the interior edges of the bottom wall, whereby a transverse interior arch is formed in the tray and the bottom side thereof, the side walls, interior axial divider walls and interior transverse divider walls being so formed as to receive the upper T bar member of the platform clip elongate upper member therewithin.

17. Attachment and carrying means for use in conjunction with the top platform of a self standing ladder, said ladder top platform being substantially rectangular in plan, side and end views with top and bottom sides and side and end edges, comprising, in combination:

(1) a container having at least a normally horizontal bottom wall and a normally substantially vertical side wall fixed at its lower end to the periphery of the bottom wall, (2) a platform clip including an elongate upper member of substantial T-shape in vertical transverse section, said member of sufficient length to extend a distance at least substantially the distance between opposed, centered portions of the lower portion of said side wall of said container, and (3) a resilient lower clip member fixed adjacent to one end of said upper member and adapted to strongly, resiliently and removably engage the underside of the ladder top platform, and (4) a T-section passageway formed through the lower opposed portions of said container side wall essentially centrally thereof, such passageway adapted to receive the clip upper member therethrough, whereby, when the clip upper member engages the container side wall and the clip lower member engages the underside of the ladder top platform, the container is removably fixed on the platform top.

18. Means as in claim 17 wherein the T-section passageway is formed through the lower portion of each of said container side wall portions above the bottom wall thereof whereby, when the clip upper member engages the container side wall, it overlies the said bottom wall.

19. Means as in claim 17 wherein the lowermost portion of said T section passageway is formed through the bottom wall of said container enabling the vertical leg of said T clip portion to pass therethrough in the bottom portion thereof.

20. Means as in claim 17 wherein the T section passageway is walled over throughout its extension within said container.

* * * * *